US005103750A

United States Patent [19]

Sato et al.

[11] Patent Number: 5,103,750

[45] Date of Patent: Apr. 14, 1992

[54] SEWING MACHINE WITH BOBBIN THREAD MONITOR

[75] Inventors: Katsuhiko Sato, Nagoya; Yasuo Sakakibara, Hekinan; Kohtaro Miyazaki, Nagoya, all of Japan

[73] Assignee: Brother Kogyo Kabushiki Kaisha, Japan

[21] Appl. No.: 692,936

[22] Filed: Apr. 29, 1991

[30] Foreign Application Priority Data

May 18, 1990 [JP] Japan ..... 2-129696

[51] Int. Cl.[5] ..... D05B 45/00; D05B 59/02

[52] U.S. Cl. ..... 112/278; 112/262.11; 242/37 R; 250/560

[58] Field of Search ..... 112/273, 278, 262.1; 250/559, 561, 571, 560; 200/61.18; 242/37 R

[56] References Cited

U.S. PATENT DOCUMENTS

| | | | |
|---|---|---|---|
| 4,188,902 | 2/1980 | Kahan | 112/278 |
| 4,212,257 | 7/1980 | Herron et al. | 112/278 |
| 4,250,825 | 2/1981 | Kamiyama | 112/278 |
| 4,432,297 | 2/1984 | Kemmel | 112/278 |
| 4,569,298 | 2/1986 | Lindh et al. | 112/278 |
| 4,693,196 | 9/1987 | Hager | 112/273 |
| 4,805,544 | 2/1989 | Dobner et al. | 112/278 |
| 4,825,789 | 5/1989 | Garron et al. | 112/278 |
| 4,938,159 | 7/1990 | Shibata | 112/273 |
| 5,020,461 | 6/1991 | Hanyu et al. | 112/278 |
| 5,044,292 | 9/1991 | Nakamura et al. | 112/278 X |

FOREIGN PATENT DOCUMENTS

| | | | |
|---|---|---|---|
| 0160493 | 9/1984 | Japan | 112/278 |
| 61-180685 | 11/1986 | Japan . | |
| 2-134191 | 5/1990 | Japan . | |
| 2-106182 | 8/1990 | Japan . | |

*Primary Examiner*—Peter Nerbun
*Attorney, Agent, or Firm*—Oliff & Berridge

[57] ABSTRACT

According to a sewing machine with a bobbin thread monitor, the light emitted from a luminescence element is reflected by a bobbin thread or a rotating hook bobbin and received by a light receiving element. The light receiving element outputs the detection signal according to an amount of thread remaining on the bobbin based on the reflection light. A color sensor detects the wave length of the color of the bobbin thread and outputs the signal according to the result of the detection. A CPU corrects the detection signal output from the light receiving element based on the signal output from the color sensor so that the amount of thread remaining on the bobbin is detected.

18 Claims, 5 Drawing Sheets

SEWING MACHINE WITH BOBBIN THREAD MONITOR

BACKGROUND OF THE INVENTION

1. Field of the invention

The present invention relates to a sewing machine with a bobbin thread monitor and more particularly, to a sewing machine with a bobbin thread monitor for indicating an amount of thread remaining on a bobbin.

2. Description of Related Art

A conventional sewing machine with a bobbin thread monitor is disclosed, for example, in Japanese Utility Model Laid-Open Publication (Jikkaisho) No. 61-180685. According to the bobbin thread monitor, when a rotating hook ceases rotating, a light detector irradiates the circumferential surface of a bobbin winder spindle with a light. The light reflected by the circumferential surface of the bobbin winder spindle is detected by the light detector. Based on the intensity of the detected light, the bobbin thread monitor detects an amount of thread remaining on a bobbin.

The above-mentioned bobbin thread monitor, however, cannot accurately detect the amount of thread remaining on the bobbin when dust or oil adheres to the light detector.

SUMMARY OF THE INVENTION

In order to detect the amount of thread remaining on the bobbin more accurately, the present inventor has developed a thread monitor for detecting the amount of thread remaining on the bobbin based on a ratio of the light reflected by the circumferential surface of the bobbin winder spindle, proposed by the same inventor as this application and disclosed in Japanese Patent Laid-Open Publication (Tokkaihei) No. 2-13419', published May 23, 1990.

However, even in the above mentioned thread monitor, when a color of a bobbin thread is changed, the amount of thread remaining on the bobbin cannot be detected accurately, because the reflection condition of the light subtly changes according to the color of the bobbin thread to be used. The change of the reflection condition of the light causes a fluctuation of a detection signal, so that the amount of thread remaining on the bobbin cannot be detected accurately. For instance, when the color of the bobbin thread is changed, even when the same amount of thread remains on the bobbin, the bobbin thread monitor sometimes judges that the amount of the thread remaining on the bobbin is different from the previous amount of the thread remaining on the bobbin.

An object of the present invention is to provide a sewing machine with a bobbin thread monitor which can accurately detect an amount of thread remaining on a bobbin without being influenced by the color of the bobbin thread.

A further object of the present invention is to provide a sewing machine with a bobbin thread monitor, which can accurately detect the amount of thread remaining on the bobbin by reducing the effect of different types of bobbin thread and dirt which adheres on the bobbin thread monitor.

To achieve the above mentioned objects, a sewing machine of the present invention includes the following: output means for outputting a light wave toward a bobbin thread wound on a bobbin; light amount detection means for providing a detection signal indicative of an amount of the light wave reflected by the bobbin thread; bobbin thread color detection means for providing a detection signal indicative of a wave length of the light wave reflected by the bobbin thread; and light amount detection signal correction means for correcting the detection signal from the light amount detection means based on the detection signal from the bobbin thread color detection means.

In the present invention, the output means outputs the light wave toward the bobbin thread wound in the bobbin. The light amount detection means detects the amount of the light wave reflected by the bobbin thread, and the bobbin thread color detection means detects the wave length of the light wave reflected by the bobbin thread. The light amount detection signal correction means corrects the detection signal from the light amount detection means based on the detection signal from the bobbin thread color detection means.

According to a sewing machine with a bobbin thread monitor of the present invention, the detection result is not influenced by the color of the bobbin thread. Further, by reducing the effects of a particular color of the bobbin thread and various kinds of dirt which adhere on the bobbin thread monitor, the amount of thread remaining on the bobbin can be accurately detected.

BRIEF DESCRIPTION OF THE DRAWINGS

A preferred embodiment of the present invention will be described in detail with reference to the following figures wherein:

FIG. 2 (*b*) is a side view showing a rotating hook bobbin case constituting the rotating looptaker;

DETAILED DESCRIPTION OF THE PREFERRED EMBODIMENTS

Figure 1:
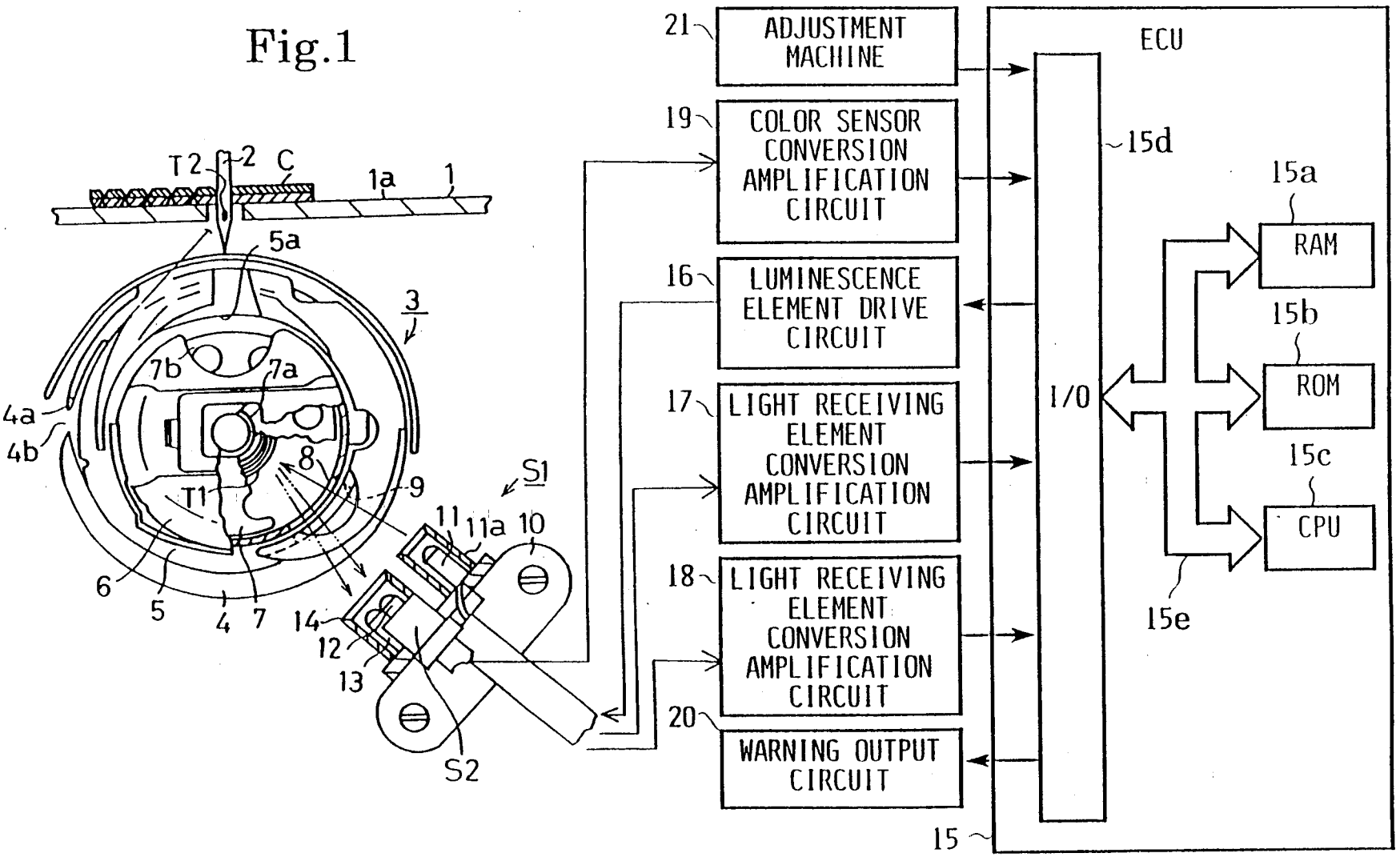
FIG. 1 is a front view showing a rotating looptaker and a bobbin thread monitor of the first embodiment.

As shown in FIG. 1, a rotating looptaker 3 for forming a seam in lock stitch on a work fabric by cooperating with a needle 2 which can move up and down is supported in a bed 1 of a sewing machine. The rotating looptaker 3 provides a rotating hook 4 which can rotate with synchronization of up-down motion of the needle 2. On both edges of the rotating hook 4, a hook 4*a* and a cutout portion 4*b* are formed. A rotating hook bobbin case holder 5 is supported in a state of rest in the rotating hook 4.

A rotating hook bobbin case 6 is detachably provided in an accommodation portion 5*a* of the rotating hook bobbin case holder 5. A rotating hook bobbin 7 is detachably and rotatably hook bobbin 7 provides a hollow shaft 7*a* on which a bobbin thread T1 is wound, and a pair of jaw portions 7*b* mounted on both ends of the hollow shaft 7*a* .

Figure 2B:
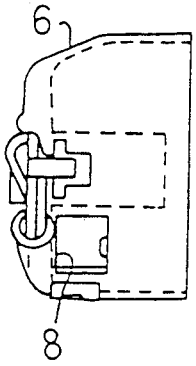
FIG. 2 (*a*) is a side view showing a rotating hook bobbin case holder constituting the rotating looptaker.
Figure 2A:
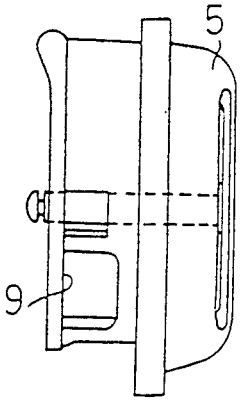

As shown in FIG. 1 and FIG. 2, openings 8 and 9 are formed on the surrounding walls of the rotating hook bobbin case holder 5 and the rotating hook bobbin case 6. respectively. The openings 8 and 9 can be roughly coincident with each other, and they are supported in face-to-face relation with the cutout portion 4*b* of the rotating looptaker 3. A passage for connecting the inside of the rotating looptaker 3 with the outside of the rotating looptaker 3 is formed by the cutout portion 4*b* and each of the openings 8 and 9.

A bobbin thread remaining sensor S1 for measuring an amount of thread remaining on the bobbin and a color sensor S2 for distinguishing the color of the bobbin thread T1 are provided to adjoin the rotating looptaker 3.

Figure 4:
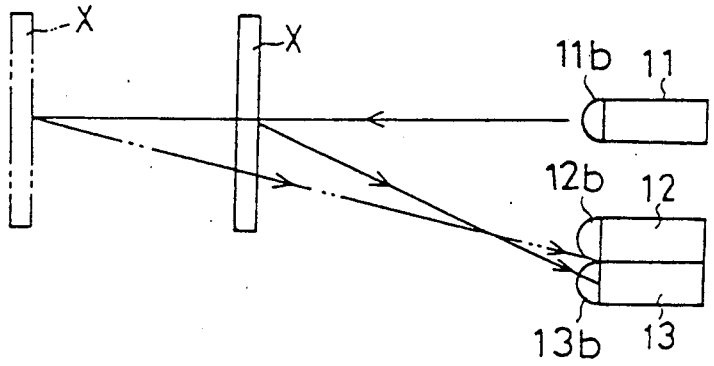
FIG. 4 is an explanation view showing a detection principle.

The bobbin thread remaining sensor S1 comprises a base material 10 and a luminescence element 11 and a pair of light receiving elements 12 and 13 formed on base material 10. The luminescence element 11 is provided in face-to-face relation with the openings 8 and 9, and in the plane which orthogonally crosses a rotational axis of the rotating looptaker 3. On one side of the luminescence element 11, each of the light receiving elements 12 and 13 are arranged in a plane which orthogonally crosses a rotational axis of the rotating looptaker 3. The luminescence element 11 is covered with a case 11*a* having a light penetration portion, and the light receiving elements 12 and 13 are covered with a case 14 having a light penetration portion. The luminescence element 11 has a lens 11*b* provided on its head as shown in FIG. 4. The light irradiated from the luminescence element 11 is collected by the lens 11*b* to become a spot light. Each of the light receiving elements 12 and 13 has lenses 12*b* and 13*b*, respectively. The reflection light is collected by each of the lenses 12*b* and 13*b* to become a spot light.

On the other hand, the color sensor S2 is a semiconductor sensor using, for instance, a photodiode. The color sensor S2 is arranged to adjoin the light receiving elements 12 and 13, and in the plane which orthogonally crosses a rotational axis of the rotating looptaker 3 in order to receive the light reflected by the bobbin thread T1 after being irradiated by the luminescence element 11 of the bobbin thread remaining sensor S1.

In the sewing machine, an electronically controlled unit (ECU) 15 for controlling various controls such as the detection of an amount of thread remaining on the bobbin or the like, is installed.

The ECU 15 comprises a RAM 15*a* for storing temporary data, a ROM 15*b* for storing a map, control programs and values for judging an amount of thread remaining on the bobbin and the like, a CPU 15*c* for carrying out various operations and rendering judgment, a signal input-output portion 15*d*, and bus 15*e* for connecting the above mentioned elements. The map stored in ROM 15*b* contains information related to plural correction values associated with plural different bobbin thread colors. The map is accessed by CPU 15*c*. In particular, CPU 15*c* accesses the map in ROM 15*b* by bobbin thread color to determine the particular correction value corresponding to the bobbin thread color. The correction value will be discussed further hereinbelow.

The luminescence element 11 is connected to the ECU 15 through a luminescence element drive circuit 16. Each of the light receiving elements 12 and 13 is connected to the ECU 15 through light receiving element conversion amplification circuits 17 and 18, respectively. Further, the color sensor S2 is connected to the ECU 15 through a color sensor conversion amplification circuit 19. In addition, a warning output circuit 20 for warning that the amount of thread remaining on the bobbin has decreased below a predetermined amount is connected to the ECU 15. Moreover, an adjustment machine 21 for inputting a predetermined standard value to the ECU 15 after performing a fine adjustment of the predetermined standard value and each element 11, 12 and 13 are connected to the ECU 15.

Adjustment machine 21 includes a variable resistor and an analog-to-digital (A/D) converter. Before beginning each sewing operation, the operator winds a minimum amount of thread on the rotating hook bobbin 7 to set a minimum level for thread amount detection. Bobbin thread remaining sensor S1 operates to emit a light wave to the rotating hook bobbin 7 having a minimum amount of thread wound thereon, receive the light reflected from the rotating hook bobbin 7 at two light receiving elements 12, 13 and CPU 15*c* calculates a ratio of both detection signals detected by the two light receiving elements 12, 13. The CPU 15*c* corrects the ratio based on the correction value associated with the bobbin thread color detected by the color sensor 52. The operator adjusts the variable resistor until warning output circuit 20 warns that the amount of thread remaining on the bobbin has decreased below a predetermined amount. When the warning is output, a value set by the variable resistor is determined to be the predetermined standard value.

Next, an operation of the sewing machine adopting the above mentioned construction will be explained.

According to the sewing machine having this construction, as the rotation looptaker 3 is rotated with synchronization of up-down motion of the needle 2, a seam in lock stitch is formed on a work fabric C with a needle thread T2 threaded in a needle 2 and the bobbin thread T1 sent out from the rotating bobbin 7 in the rotating looptaker 3. The luminescence element 11 is operated through the luminescence element drive circuit 16 according to the control of the ECU 15, and a spot light is emitted from the luminescence element 11 to the rotating hook bobbin 7 in the rotating looptaker 3.

When the cutout portion 4*b* of the rotating hook 4 coincides with the rotating hook bobbin case holder 5 and each of the openings 8 and 9 in the rotating hook bobbin case 6, the spot light emitted from the luminescence element 11 passes through the cutout portion 4*b* and each of the openings 8, 9 to irradiate the bobbin thread T1 on the rotating hook bobbin 7. The light reflected by the bobbin thread T1 passes through the cutout portion 4*b* and each of the openings 8 and 9, to be input to each of the light receiving elements 12 and 13 and the color sensor S2. Besides, when the cutout portion 4*b* of the rotating hook 4 does not coincide with each of the openings 8 and 9, the light reflected by the circumferential surface of the rotating hook 4 is input to each of the light receiving elements 12 and 13 and the color sensor S2.

Thereby, each detection signal indicative of the amount of light received by the light receiving element conversion amplification circuits 17 and 18 from each of the light receiving elements 12, 13 is input to the ECU 15. Moreover, the signal indicative of the wave length of the reflected light is input from the color sensor S2 to the ECU 15 through the color sensor conversion amplification circuit 19.

Figure 3:
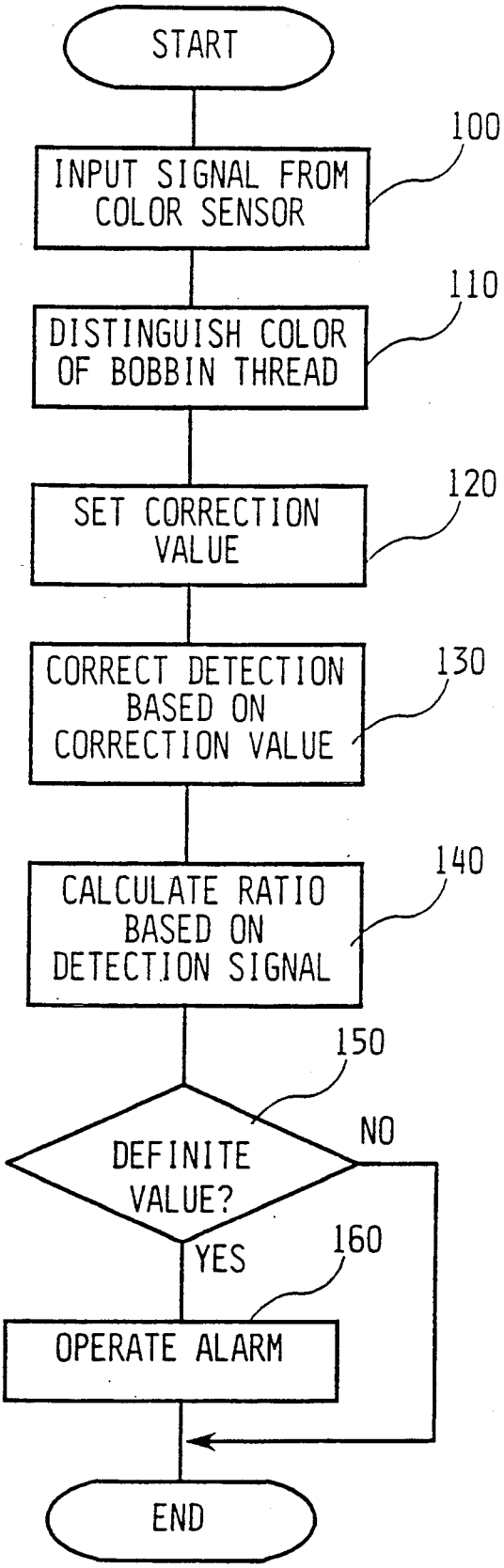
FIG. 3 is a flowchart showing a control to be operated by the bobbin thread monitor.

Next, the correction based on the input from the color sensor S2 will be explained with reference to the flowchart in FIG. 3.

When the light reflected by the bobbin thread T1 is input to the color sensor S2, the color sensor S2 outputs the signal indicative of the wave length of the input light to the ECU 15 through the color sensor conversion amplification circuit 19 (Step 100). The CPU 15*c* in the ECU 15 distinguishes the color of the bobbin thread T1 based on the input value (Step 110). According to the distinguished color of the bobbin thread T1, the CPU 15*c* sets the correction value for correcting each detection signal output from the light receiving elements 12 and 13 in the bobbin thread remaining sensor S1 based on the map stored in the ROM 15*b* (Step 120).

Next, the CPU 15*c* calculates the ratio of both detection signals (Step 130) and then corrects the ratio using the correction value set in Step 120 (Step 140). The CPU 15*c* compares the corrected ratio with the predetermined standard value set by the adjustment machine 21 (Step 150). According to the comparison result, when the CPU 15*c* judges that the amount of thread remaining on the bobbin decreases below a predetermined amount, the CPU 15*c* operates the warning output circuit 20 so that an alarm such as a buzzer or a lamp is operated (Step 160).

Hereinafter, the detection principle for executing the above mentioned process will be explained.

First, an example wherein the bobbin thread having a fixed color is used will be explained.

As shown in FIG. 4, there are illustrated two cases, one in which the detection part X is in a solid line position against the light receiving element 12, and the other in which the detection part X is in a two-dot chain line position which is far from the solid line position against the light receiving element 12. The reflection angle of the spot light emitted by the luminescence element 11 and collected by the lens 11*b* is changed, according to the position of the detection part X. Since the ratio of the light amount of the spot light collected L by the each of the lenses 12*b* and 13*b* and input to each of the light receiving elements 12 and 13 is changed according to the change of the reflection angle of the spot light, the ratio of the detection signal output from each of the light receiving elements 12 and 13 is changed.

The ratio of the detection signals from the light receiving elements 12 and 13, therefore, corresponds to an interval between the luminescence element 11 and the detection part X. In the present invention, the detection part X comprises the bobbin thread T1 on the rotating hook bobbin 7 and the amount of thread remaining on the rotating hook bobbin 7 can be detected. Thus, the interval between the luminescence element 11 and the bobbin thread T1 can be detected by calculating the ratio of the detection signals from each of the light receiving elements 12 and 13. If the value corresponding to the ratio of the detection signals from each of the light receiving elements 12 and 13 is set as the standard value by the above mentioned adjustment machine 21, the amount of the bobbin thread T1 remaining on the bobbin can be detected. Of course the detection signal needs to be a detection signal in the case that the amount of thread remaining on the bobbin is minimum.

If, however, the different color bobbin thread T1 is used, since the light reflection condition differs according to the color of the bobbin thread T1, the amount of thread remaining on the bobbin cannot be accurately detected by only the bobbin thread remaining sensor S1. Accordingly, it is necessary that the detection signal be corrected according to the color of the bobbin thread T1. For example, if a white color bobbin thread T1 is used, since an amount of the light reflected by the bobbin thread T1 is large, the amount by which the detection signal is corrected is a relatively small amount. On the other hand, if a black color bobbin thread T1 is used, since an amount of the light reflected by the bobbin thread T1 is small, the amount by which the detection signal is corrected is a relatively large amount in comparison to the correction value used with white color bobbin thread. For example, the signal detected by one of the light receiving elements is $R_1$. The signal detected at the other of the light receiving elements is $R_2$. The ratio R′ calculated by the CPU 15*c* is determined to be $R_1/R_2$. The CPU 15*c* corrects ratio R′ by multiplying ratio R′ by a correction value C. When white color bobbin thread is used, the value of correction value C is a relatively small amount while when black color bobbin thread is used, the value of correction value C is a larger amount than its value for white color bobbin thread. Thus, as the value of the ratio is calculated to be an appropriate value, the amount of thread remaining on the bobbin can be accurately detected.

In the present embodiment, when the amount of thread remaining on the bobbin is detected, the color of the bobbin thread T1 is distinguished by the color sensor S2, and an appropriate correction of the detected thread amount is executed based on this judgment of the color. Therefore, when various bobbin thread colors are used, it can be easily confirmed whether the bobbin thread T1 needs to be replenished. Moreover, the amount of thread remaining on the bobbin is detected based on the ratio of the reflection signal output from a pair of light receiving elements 12 and 13. As compared with a detection operation by a single light receiving element, the above mentioned operation can accurately execute a detection operation, since detection sensitivity does not fluctuate frequently under the influence of dust, oil or the like which adhere to the light receiving elements 12 and 13.

Next, a second embodiment of this invention will be explained to illustrate the difference between the second embodiment and the first embodiment of FIG. 1.

Figure 5:
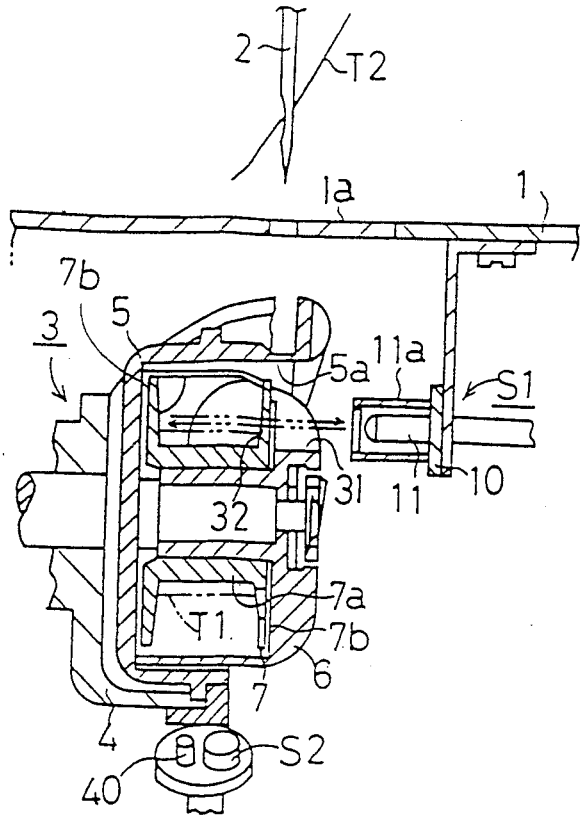
FIG. 5 is a sectional view showing the rotating looptaker and the bobbin thread monitor of the second embodiment.
Figure 6:
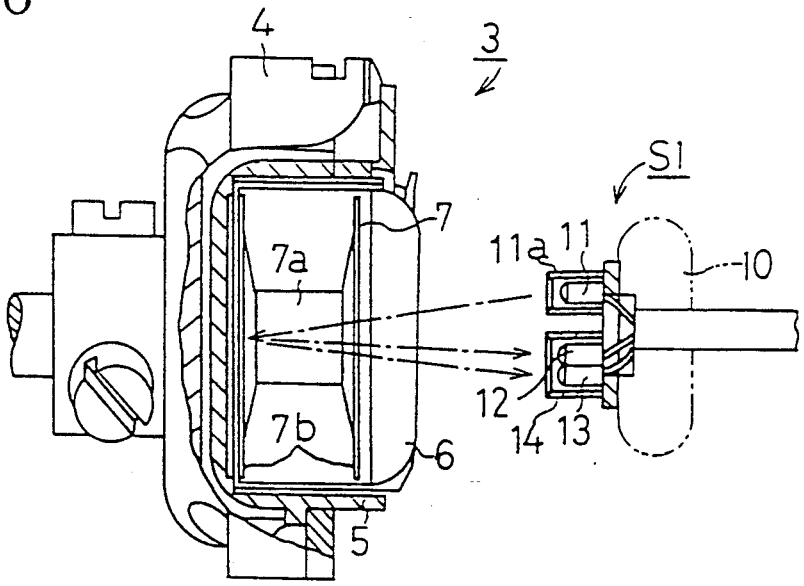
FIG. 6 is a plane sectional view showing the rotating looptaker and the bobbin thread monitor of the second embodiment.

As shown in FIG. 5 and FIG. 6, in the second embodiment, the position of the bobbin thread remaining sensor S1 is different than its position in the first embodiment. In addition, color sensor S2 has its own luminescence element 40.

A cutout portion 31 is formed in the outside of the rotating hook bobbin case 6. A plurality of openings 32 are formed, respectively, to be in face-to-face relation with the cutout portion 31 in the vicinity of the hollow shaft *7a* in an outside jam portion *7b* of the rotating hook bobbin 7. A passage for connecting the inside of the rotating looptaker 3 with the outside of the rotating looptaker 3 is formed by the cutout portion 31 and the opening 32. In the bed 1, in the surface which is parallel to the rotational axis of the rotating looptaker 3, the luminescence element 11 and each of the light receiving elements 12 and 13 are arranged in face-to-face relation with the cutout portion 31.

In addition, the color sensor S2 and the luminescence element 40 are arranged at the position where the bobbin thread remaining sensor S1 is arranged in the first embodiment.

In this embodiment, therefore, the light emitted from the luminescence element in the bobbin thread remaining sensor S1 and collected by the lens 11*b* is introduced between both the jam portion 7*b* through the cutout portion 31 of the rotating hook bobbin case 6 and the opening 32 of the rotating hook bobbin 7. If the amount of the thread remaining on the bobbin is more than a predetermined amount, the light reflected by the bobbin thread T1 is input to each of the light receiving elements 12 and 13 through the opening 32 and the cutout portion 31 by the lenses 12*b* and 13*b*, respectively. As shown in two-dot chain line in FIG. 5, if the amount of thread remaining on the bobbin decreases below the predetermined amount, the light from the luminescence element 11 arrives at the jam portion 7*b* inside of the rotating hook bobbin 7. The light reflected by the jam portion 7*b* is input to each of the light receiving elements 12 and 13, and the detection signal indicative of the amount of the light is output. On the other hand, the light from the luminescence element 40 follows the same route as the light from the luminescence element 11 in the first embodiment and is input to the color sensor S2 so that the color of the bobbin thread T1 is detected.

After the detection signal from the light receiving element 40 is corrected based on the color of the bobbin thread, the CPU 15*c* calculates the ratio of the amount of the light input to each of the light receiving elements 12 and 13. Additionally, the CPU 15*c* compares the corrected ratio based on the output from the color sensor S2 with the standard value set according to the interval between each of elements 11, 12 and 13 and the jam portion 7*b* inside of the rotating hook bobbin 7. Thus, as in the first embodiment, the CPU 15*c* can accurately detect the fact that the amount of thread remaining on the bobbin has decreased below the predetermined amount.

While this invention has been described in conjunction with specific embodiments thereof, it is evident that many alternatives, modifications and variations will be apparent to those skilled in the art. For instance, it may be provided a plurality of lenses in face-to-face relation with each of the elements 11, 12 and 13 in the cases 11*a* and 14, and a fiber can be provided for transferring light between each of the lenses and each of the elements 11, 12 and 13. Further, an input-output device can be used for inputting or outputting infrared rays, rather than visible rays, to a detection device. Accordingly, the preferred embodiment of the invention as set forth herein is intended to be illustrative, not limiting. Various changes may be made without departing from the spirit and scope of the invention as defined in the following claims.

What is claimed is:

1. A sewing machine with a bobbin thread monitor comprising:

output means for outputting a light wave toward a bobbin thread wound on a bobbin;

light amount detection means for detecting an amount of the light wave reflected by the bobbin thread and for generating a detection signal;

bobbin thread color detection means for detecting a length of the light wave reflected by the bobbin thread and for generating a detection signal; and light amount detection signal correction means for correcting the detection signal from said light amount detection means based on the detection signal from said bobbin thread color detection means.

2. The sewing machine according to claim 1, wherein said output means includes a single light source, and wherein the light wave emitted from said light source is input to said light amount detection means and said bobbin thread color detection means in branched form.

3. The sewing machine according to claim 1 wherein said output means includes a first light source and a second light source, the light wave from said first light source being input to said light amount detection means, the light wave from said second light source being input to said bobbin thread color detection means.

4. The sewing machine according to claim 1, wherein said light amount detection signal correction means comprises;

storage means for storing a correction value based on the length of the light wave detected by said bobbin thread color detection means.

5. The sewing machine according to claim 4, wherein said light amount detection signal correction means corrects the detection signal from said light amount detection means based on said correction value of said storage means.

6. The sewing machine according to claim 5, wherein said light amount detection means includes a luminescence element and two light receiving elements that receive light from said luminescence element in branched form and determines a ratio of the light received by said two light receiving elements, and said light amount detection signal correction means corrects the determined ratio by multiplying the determined ratio by said correction value of said storage means.

7. The sewing machine according to claim 6, wherein said correction value of said storage means is predetermined to be larger as a color of a bobbin thread wound on the bobbin is darker.

8. A bobbin thread monitor for use in a sewing machine, comprising:

a bobbin thread remaining sensing means for sensing an amount of thread remaining on a bobbin;

bobbin thread color signal supplying means for supplying a thread color signal related to the color of thread on the bobbin; and correction means for correcting the amount of thread sensed by said bobbin thread remaining sensing means based on said thread color signal supplied by said bobbin thread color signal supplying means.

9. The bobbin thread monitor according to claim 8, wherein said bobbin thread remaining sensing means outputs a light wave toward the bobbin thread, detects the amount of the light wave reflected by the bobbin thread and provides a detection signal indicative of the detected amount of light.

10. The bobbin thread monitor according to claim 9, wherein said bobbin thread remaining sensing means includes a luminescence element and at least one light receiving element.

11. The bobbin thread monitor according to claim 10, wherein said bobbin thread sensing means includes two light receiving elements that receive light from said luminescence elements in branched form.

12. The bobbin thread monitor according to claim 11, wherein said bobbin thread color signal supplying means includes a color sensor which detects a length of the light wave reflected by the bobbin thread and generates a signal indicative thereof.

13. The bobbin thread monitor according to claim 12, wherein said bobbin thread remaining sensing means determines a ratio of the light received by said two light receiving elements and said correction means corrects the determined ratio in accordance with a signal from said color sensor to determine the actual amount of thread remaining on the bobbin.

14. A method of monitoring the amount of thread on a bobbin in a sewing machine, comprising:

sensing an amount of thread remaining on the bobbin;

detecting the color of the thread on the bobbin; and correcting the amount of the remaining thread sensed based on the color of the bobbin thread.

15. The method according to claim 14, wherein said detecting the color of the thread includes detecting the length of the light wave reflected by the bobbin thread.

16. The method according to claim 15, wherein said sensing includes detecting the light amount reflected by the thread on the bobbin and received by two light receiving elements and determining a ratio of the light amounts received by the light receiving elements and wherein said correcting includes correcting said ratio in accordance with the detected thread color to determine the actual amount of thread remaining on the bobbin.

17. The method according to claim 14, wherein said sensing includes outputting a light wave toward the bobbin, supplying a light wave reflected by the bobbin to two light receiving elements and calculating a ratio of two signals, each signal provided from one of the light receiving elements.

18. A sewing machine with a bobbin thread monitor, comprising:

output means for outputting a light wave toward a bobbin thread wound on a bobbin winder spindle;

light receiving means for receiving the light wave reflected by the bobbin thread, said light receiving means comprising two light receiving elements; and light amount detection means for detecting an amount of the light wave reflected by the bobbin thread and received by each light receiving element, and for calculating the ratio of the amount of light received by each light receiving element.

* * * * *